US007419371B2

(12) United States Patent
Minekawa et al.

(10) Patent No.: US 7,419,371 B2
(45) Date of Patent: Sep. 2, 2008

(54) SCROLL FLUID MACHINE

(75) Inventors: Naohiro Minekawa, Yokohama (JP); Masatomo Tanuma, Yokohama (JP); Yuki Takada, Yokohama (JP); Minako Toda, Yokohama (JP)

(73) Assignee: Anest Iwata Corporation, Yokohama-shi, Kanagawa (JP)

( * ) Notice: Subject to any disclaimer, the term of this patent is extended or adjusted under 35 U.S.C. 154(b) by 0 days.

(21) Appl. No.: 11/654,836

(22) Filed: Jan. 18, 2007

(65) Prior Publication Data

US 2007/0178001 A1 Aug. 2, 2007

(30) Foreign Application Priority Data

Jan. 27, 2006 (JP) ..... 2006-019130

(51) Int. Cl.
*F03C 2/00* (2006.01)
*F04C 15/00* (2006.01)

(52) U.S. Cl. ..... 418/101; 418/6; 418/55.2; 418/59; 418/83

(58) Field of Classification Search ..... 418/55.1, 418/55.4, 55.6, 59, 83, 101, 6; 165/86, 104.21
See application file for complete search history.

(56) References Cited

U.S. PATENT DOCUMENTS 5,346,374 A * 9/1994 Guttinger ..... 418/6
5,842,843 A * 12/1998 Haga ..... 418/101
6,109,897 A 8/2000 Haga
7,121,816 B2 * 10/2006 Matsushima ..... 418/101
7,210,913 B2 * 5/2007 Midorikawa ..... 418/55.1

FOREIGN PATENT DOCUMENTS

JP 2003269101 A * 9/2003

* cited by examiner

*Primary Examiner*—Theresa Trieu
(74) *Attorney, Agent, or Firm*—Skinner and Associates

(57) ABSTRACT

In a scroll fluid machine, a driving shaft extends axially to allow an orbiting scroll to revolve with respect to a fixed scroll thereby compressing a gas introduced from the outer circumference of the fixed scroll in a compressing chamber formed between the orbiting and fixed scrolls. From one end of the driving shaft, external air is introduced in a cooling hole extending axially of the driving shaft to cool the driving shaft. A cooling fan is rotatably secured at one end of the driving shaft to rotate by the driving shaft to cool the fixed scroll. The cooling fan comprises a base plate having a main fin on one side surface facing the side of the fixed scroll and a plurality of auxiliary fins on the other side surface to prevent cooling-finished air from invading into the cooling hole of the driving shaft.

4 Claims, 3 Drawing Sheets

SCROLL FLUID MACHINE

BACKGROUND OF THE INVENTION

The present invention relates to a scroll fluid machine such as a scroll vacuum pump or a scroll compressor.

A scroll fluid machine comprises a fixed scroll having a spiral fixed wrap; an orbiting scroll having an orbiting wrap engaging with the fixed wrap and being rotatably mounted around an eccentric axial portion of a driving shaft connected to a drive source and a cooling fan driven by the driving shaft to cool a plurality of cooling fins on the surface of the fixed scroll, a cooling path being formed axially in the driving shaft to allow a cooling gas to be introduced from one end and to be discharged from the other end thereby cooling heat generated under compression during transferring external air taken from the outer circumference to the center at a high-temperature central portion to allow bearings and sealing members in the vicinity of the center of the orbiting scroll to be cooled efficiently as disclosed in U.S. Pat. No. 6,109,897A.

However, in the scroll fluid machine, on the way of discharging a cooling-finished or warmed gas which cooled the cooling fins by rotation of the cooling fan to the outside, the cooling-finished gas flows into a gap between the cooling fan and a fan cover covering the cooling fan, so that the gas is likely to go into the cooling path from an opening provided at one end of the driving shaft. Thus, although non-used external air is introduced in the cooling path, the cooling path will not be cooled effectively.

SUMMARY OF THE INVENTION

In view of the disadvantage in the prior art, it is an object of the invention to provide a scroll fluid machine that effectively cools central parts such as bearings heated by a compressed gas.

BRIEF DESCRIPTION OF THE DRAWINGS

The features and advantages of the invention will become more apparent from the following description with respect to embodiments as shown in accompanying drawings wherein.

DETAILED DESCRIPTION OF THE PREFERRED EMBODIMENTS

Figure 1:
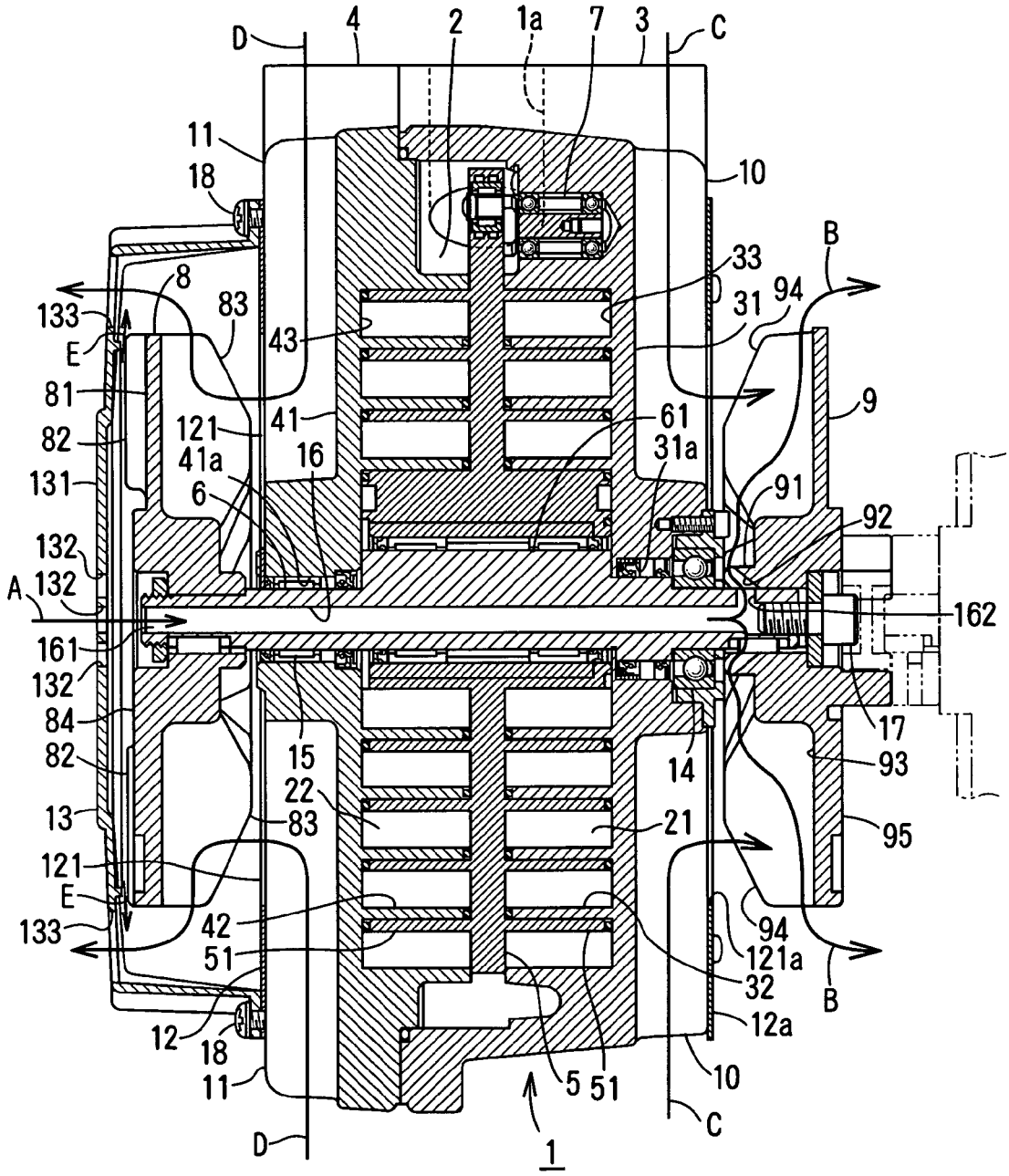
FIG. 1 is a vertical sectional view showing one embodiment of a scroll fluid machine according to the present invention.
Figure 4:
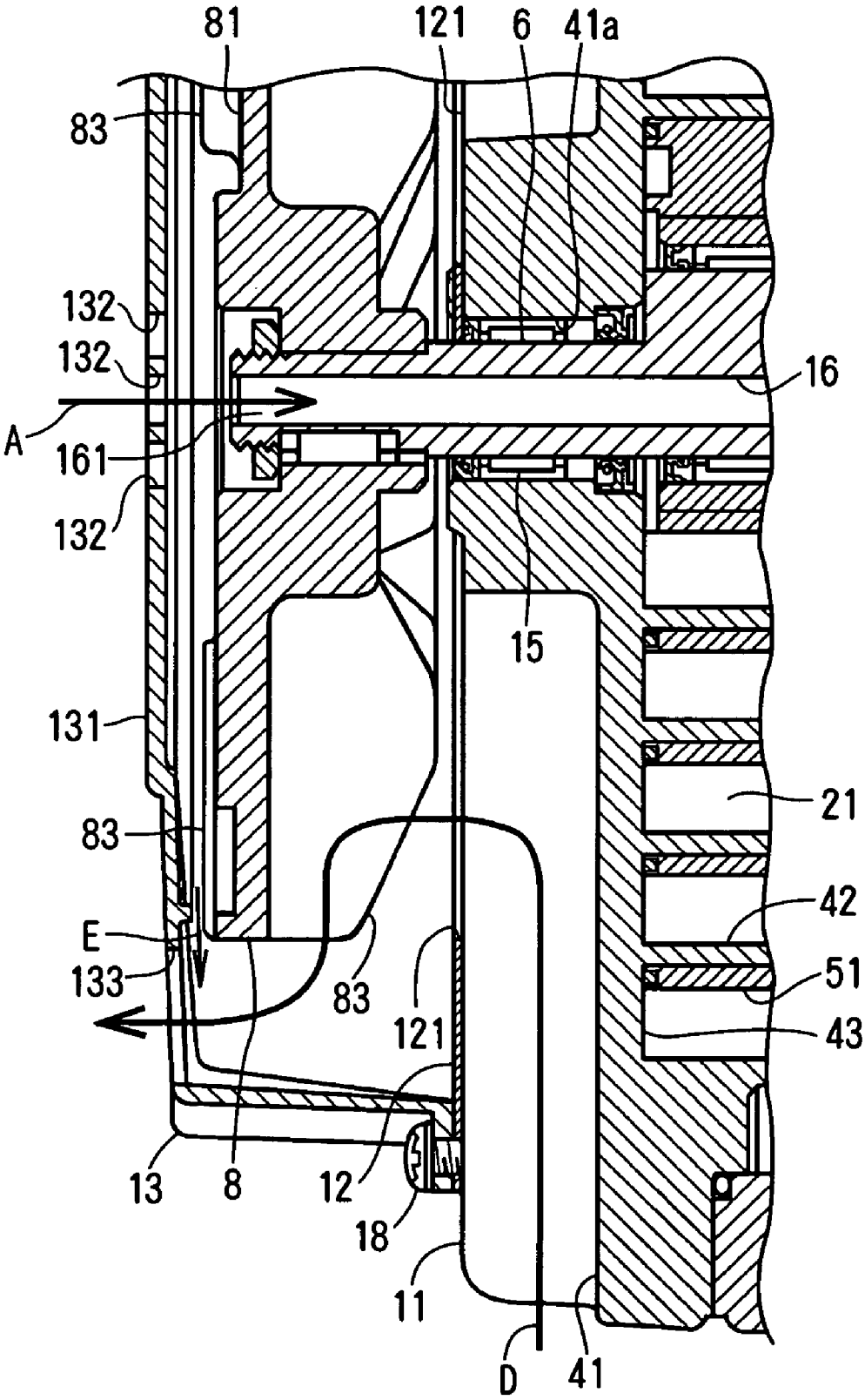
FIG. 4 is an enlarged vertical sectional view of the main part in FIG. 1.

The left in FIGS. 1 and 4 is deemed as front and the right is deemed as rear.

A cylindrical thin housing 1 comprises a rear casing 3 and a front cover 4. On the outer circumference, there are an inlet 1*a* for sucking external air into the housing 1 and an outlet (not shown) for discharging a gas compressed in the housing.

The casing 3 and cover 4 comprise circular fixed end plates 31 and 41 respectively facing each other. On the facing surfaces of the fixed end plates 31,41, spiral or involute-curved fixed wraps 32,42 are provided to form fixed scrolls 33,43.

On the rear surface of the fixed scroll 33 and on the front surface of the fixed scroll 43, a plurality of cooling fins radially extend.

In a space 2 between the fixed scrolls 33 and 43, an orbiting scroll 5 is rotatably supported around an eccentric axial portion 61 of a driving shaft 6 at the center of the housing 1.

The driving shaft 6 is jointed at the rear end to a motor (not shown) as driving source and rotatably mounted in axial holes 31*a*,41*a* at the center of the fixed end plates 31,41 via bearing 14,15.

The orbiting scroll 5 comprises orbiting wraps 51,51 engaging with the fixed wraps 32,42 shifting by 180 degrees and is connected to the fixed end plates 31 with three known pin-crank-type self-rotation preventing devices 7 equally spaced on the outer circumference.

The driving shaft 6 is rotated by the motor, so that the orbiting scroll 5 is revolved thereby reducing compressing chambers 21,22 defined by the fixed wraps 32,42 and the orbiting wraps 51,51 from the outer circumference towards the center. External air sucked from the inlet 1*a* into the compressing chamber 21,22 is gradually compressed and finally discharged from the central outlet.

Front and rear cooling fans 8,9 are mounted to the front and rear projecting ends of the driving shaft 6 from the fixed end plates 41,31 to rotate by the driving shaft 6.

The rear cooling fan 9 comprises a plurality of fins 94 on the front surface of a circular base plate 93 fixed to the rear end of the driving shaft 6, or on the opposite surface to the cooling fin 10 of the fixed scroll 33. Rotation of the fan 9 allows the fins to generate airflow in a centrifugal direction.

Figure 2:
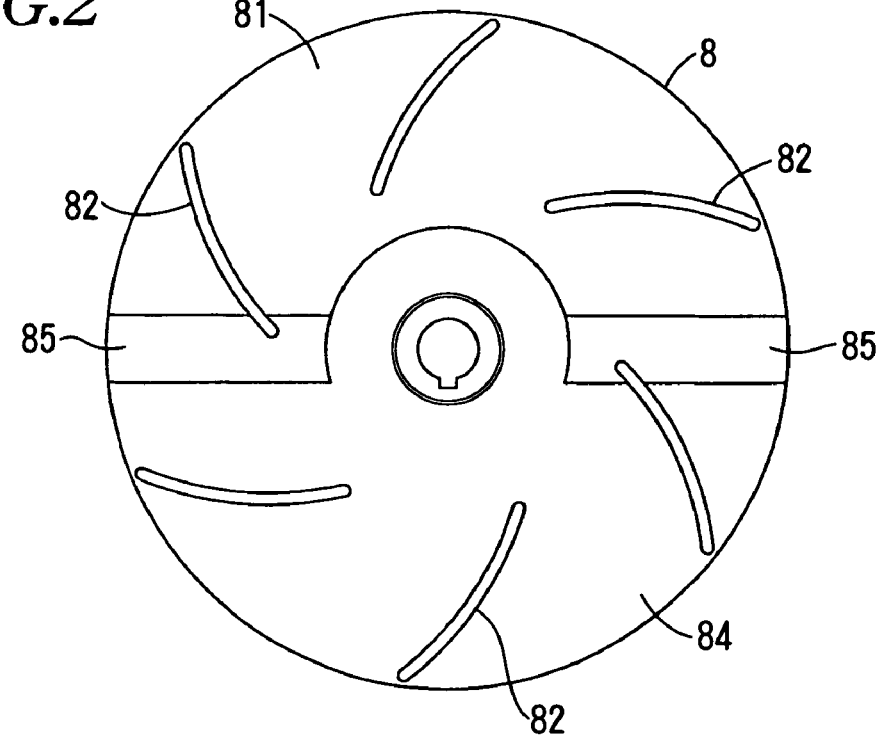
FIG. 2 is a front elevational view of a cooling fan.
Figure 3:
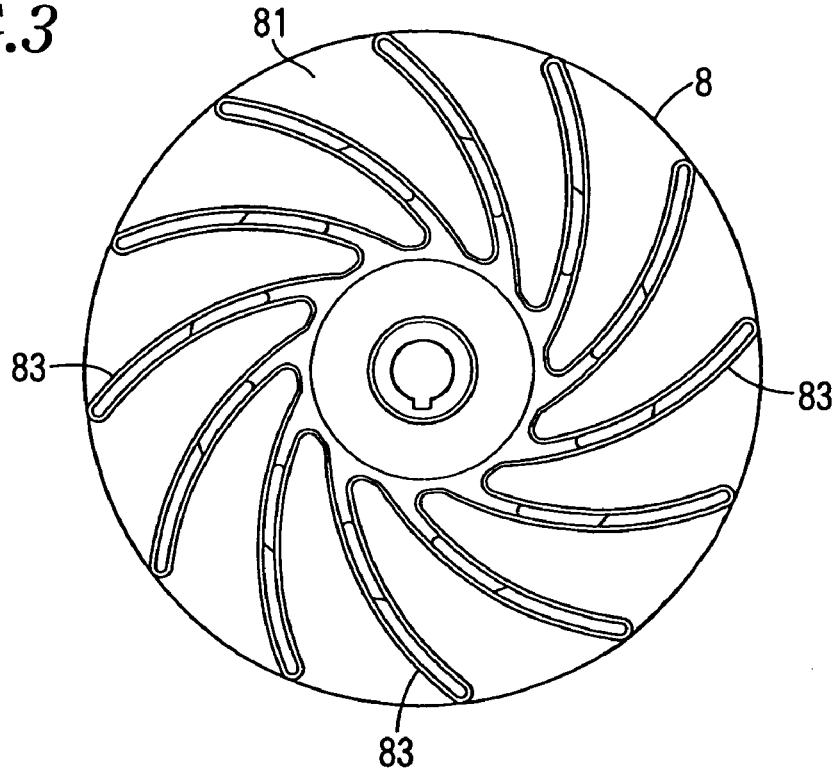
FIG. 3 is a rear elevational view of the cooling fan.

The front cooling fan 8 comprises a plurality of auxiliary fins 82 obliquely extending to the outer circumference from the proximity of the center of the driving shaft 6 at the front end in FIG. 2 and a main fin 83 inclined in a certain direction in FIG. 3 on the front and rear surfaces of a circular base plate 81 fixed to the front end of the driving shaft 6. Rotation of the fan 8 allows the fins 83 to generate airflow in a centrifugal direction.

The auxiliary fins 82 on the front surface of the base plate 81 are smaller than the main fins 83 on the rear surface of the base plate 81.

Balance weights 84,95 are provided on the front and rear cooling fans 8,9 respectively to make rotation of the driving shaft 6 smooth. The balance weights 84,95 are formed to make a lower half of the base plates 81,93 thicker than an upper half thereof.

The auxiliary fins 82 are not limited in shape to the embodiment. For example, the auxiliary fins 82 may be formed like a recess portion 85 in FIG. 2 formed on the front surface of the base plate 81 when the balance weight 84 is formed on the base plate 81.

Through the driving shaft 6, a cooling hole 16 is formed axially to allow external air to put into the hole 16 from a front opening 161 and the rear end of the cooling hole 16 is closed by a closing member 17.

At the rear end of the driving shaft 6, a plurality of discharge holes 162 are radially formed towards the outer circumference from the cooling hole 16. The discharge hole 162 communicates with a communicating hole 92 of a boss 92 of the rear fan 9 fixed to the rear end of the driving shaft 6.

Cover plates 12,12*a* are fixed to the front surface of the cover 4 and the rear surface of the casing 3 respectively. A fan cover 13 is mounted to the front surface of the cover plate 12 fixed to the cover 4 to cover the cooling fan 8.

The fan cover 13 is fixed to the front surface of the cover 4 with a plurality of bolts 18. There are formed a plurality of air-sucking holes 132 for introducing external air into the cooling hole 16 at and around the center of a front wall 131 facing the auxiliary fins 82 of the cooling fan 8. In the outer circumference of the front wall 131, there is formed a discharge hole 133 for discharging cooling-finished air by the cooling fins 11 of the fixed scroll 43.

Then, airflow will be described when the front and rear cooling fans 8,9 rotates. When the rear cooling fan 9 is rotated by the motor in a certain direction, centrifugal air flow is generated along the front surface of the base plate 93.

Thus, as shown by an arrow A in FIG. 1, external air is introduced from the air-sucking hole 132 of the fan cover 13 to the cooling hole 16 through the opening 161. Cooling-finished air which cooled the driving shaft 6 through the cooling hole 16 is discharged via the discharge hole 162 and communicating hole 92 outwards and rearwards as shown by an arrow B. At the same time, as shown by an arrow C, external air sucked from the outer circumference of the cooling fin 10 to cool the cooling fins 10 is sucked by an opening 121*a* of the cover plate 12*a* and discharged rearwards.

When the front cooling fan 8 is rotated, external air is sucked from the outer circumference of the cooling fin 11 to cool the cooling fins 11 by centrifugal airflow generated by the main fins 83 of the cooling fan 8 as shown in an arrow D. The cooling-finished air is sucked from the opening 121 of the cover plate 12 and discharged from the discharge hole 133 forwards in the outer circumference of the fan cover 13.

As shown by an arrow E in front of the front cooling fan 8, centrifugal airflow is generated by the auxiliary fins 82 in a gap between the auxiliary fins 83 and the fan cover 13.

External airflow which flows along the arrow E presses outwards against the cooling-finished air which flows along the arrow D from the outer circumference of the cooling fins 11 not to allow the cooling finished air to put into the gap between the front surface of the front cooling fan 8 and the front wall 131 of the front cover 13. The airflow along the arrow E allows external air to be introduced into the cooling hole 16 from the air-sucking hole 132 at the center of the fan cover 13.

Accordingly, the cooling-finished air warmed by cooling the cooling fins 11 is surely prevented from flowing in the cooling hole 16.

Furthermore, external air is directly introduced in the cooling hole 16 thereby effectively cooling the driving shaft 6 and the bearings 14,15 disposed in the vicinity of the center which is likely to become high temperature.

The foregoing embodiments relate to a both side scroll fluid machine in which the both-side orbiting scroll 5 is disposed between the two fixed scrolls 33 and 43. But the present invention may be applied to a one-side scroll fluid machine in which a one-side fixed scroll engages with a one-side orbiting scroll.

The present invention may comprise a fin which is determined in shape and orientation to generate centrifugal airflow with rotation in a base plate separate from a cooling fan.

The foregoing merely relates to embodiments of the invention. Various modifications and variations may be made by a person skilled in the art without departing from the scope of claims wherein:

What is claimed is:

1. A scroll fluid machine comprising:

a driving shaft having an eccentric axial portion at one end and having an axial cooling hole through which cooling external air sucked from a front end flows to cool the driving shaft and is discharged from a rear end;

a fixed scroll having a spiral fixed wrap on one side and a cooling fin at the other side;

an orbiting scroll having a spiral orbiting wrap which engages with the fixed wrap to form a compressing chamber between the fixed and orbiting wraps, the orbiting scroll being rotatably secured around the eccentric axial portion of the driving shaft; and a cooling fan rotatably secured on the driving shaft and comprising a base plate that has a main fin on one side surface facing a side surface of said fixed scroll and a plurality of auxiliary fins on the other side, the driving shaft enabling the cooling fan to rotate to cool a side of the fixed scroll by the main fin, said plurality of auxiliary fins preventing invasion of cooling-finished air into the cooling hole of the driving shaft from an outer circumference of the cooling fin of the fixed scroll.

2. A scroll fluid machine of claim 1 wherein each of said plurality of auxiliary fins extends from a vicinity of an opening of the cooling hole to an outer circumference.

3. A scroll fluid machine of claim 1 wherein one half of the base plate of the cooling fan is thicker than the other half of the base plate to form a balance weight of the cooling fan.

4. A scroll fluid machine of claim 1, further comprising a cover that covers the auxiliary fin of the base plate, the cover having an air-sucking hole at a center to introduce external air into the cooling hole of the driving shaft, and a discharge hole at an outer circumference to discharge the cooling-finished air to an outside.

* * * * *